US009197963B1

(12) United States Patent
North

(10) Patent No.: US 9,197,963 B1
(45) Date of Patent: Nov. 24, 2015

(54) BROAD SOUND FIELD LOUDSPEAKER SYSTEM

(71) Applicant: Audio Design Experts, Inc., Fountain Valley, CA (US)

(72) Inventor: Donald J. North, Los Angeles, CA (US)

(73) Assignee: Audio Design Experts, Inc., Fountain Valley, CA (US)

( * ) Notice: Subject to any disclaimer, the term of this patent is extended or adjusted under 35 U.S.C. 154(b) by 0 days.

(21) Appl. No.: 14/639,884

(22) Filed: Mar. 5, 2015

Related U.S. Application Data

(63) Continuation-in-part of application No. 14/092,772, filed on Nov. 27, 2013, which is a continuation-in-part of application No. 13/903,927, filed on May 28, 2013.

(51) Int. Cl.
*H04R 5/00* (2006.01)
*H04R 5/02* (2006.01)

(52) U.S. Cl.
CPC ..... *H04R 5/02* (2013.01)

(58) Field of Classification Search
CPC ..... H04S 3/00
USPC ..... 381/17, 18, 27, 307
See application file for complete search history.

(56) References Cited

U.S. PATENT DOCUMENTS

| | | | | |
|---|---|---|---|---|
| 4,866,774 | A | 9/1989 | Klayman | |
| 5,117,459 | A | 5/1992 | McShane | |
| 2011/0158413 | A1 | 6/2011 | Goldfarb | |
| 2011/0249857 | A1 * | 10/2011 | Fletcher | 381/386 |

OTHER PUBLICATIONS

International Search Report dated Sep. 12, 2014 from corresponding international application PCT/US2014/037575 USPTO PCT Division/ Authorized Officer Shane Thomas.

* cited by examiner

*Primary Examiner* — Paul S Kim
*Assistant Examiner* — Katherine Faley
(74) *Attorney, Agent, or Firm* — Plager Schack LLP

(57) ABSTRACT

A sound system processor for converting left and right channel signals from an audio source into composite left and right signals and employing at least one low and high pass filters, a plurality of sum processors, and at least one difference processor so as to create at least two or more composite signals for delivery to speaker drivers to generate a broad sound field from a compact multi-speaker sound system source.

9 Claims, 11 Drawing Sheets

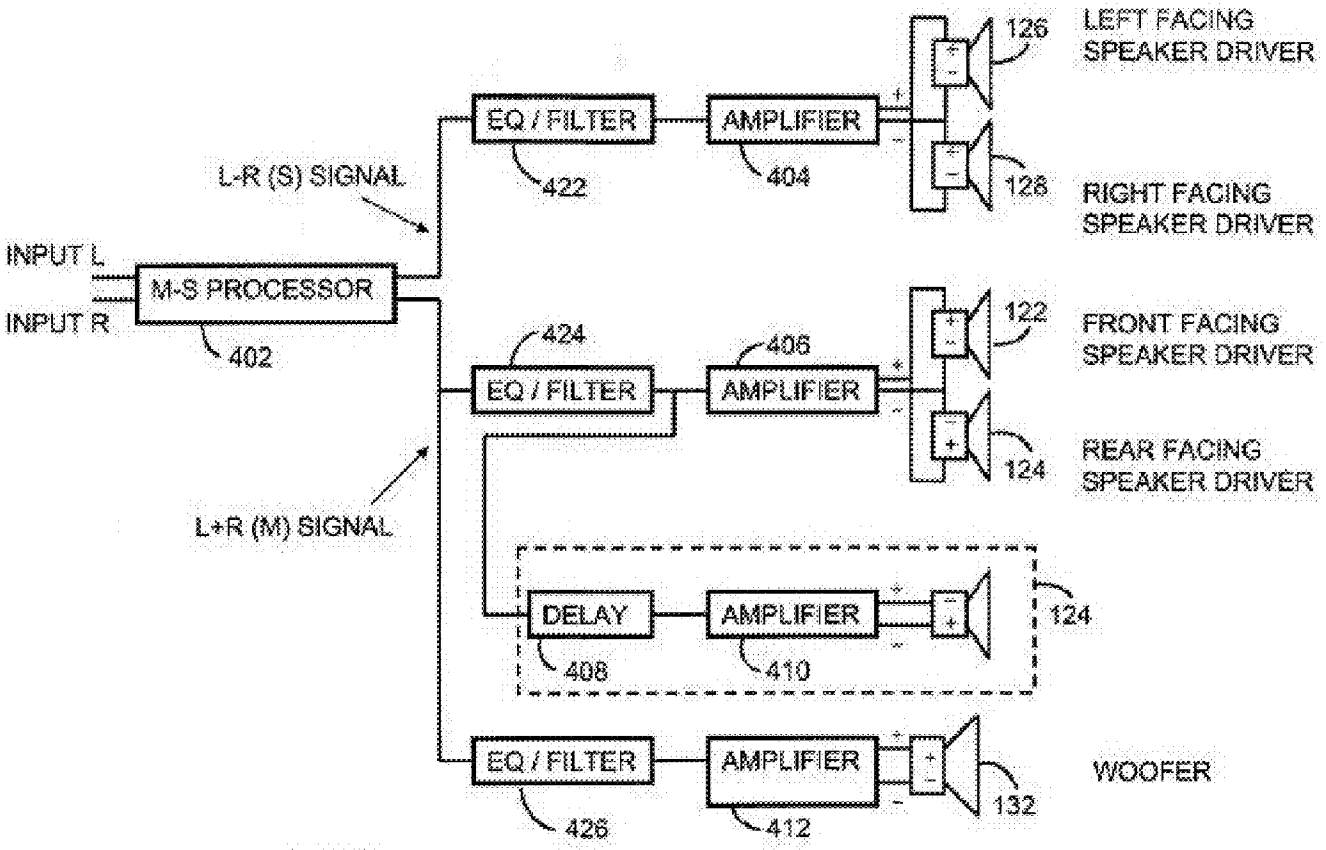
FIG. 1 - PRIOR ART

BROAD SOUND FIELD LOUDSPEAKER SYSTEM

RELATED APPLICATION

The present application is a continuation-in-part of application Ser. No. 14/092,772, filed on Dec. 5, 2013, which is a continuation-in-part of application Ser. No. 13/903,927, filed on May 28, 2013, the entire contents of which are incorporated herein in their entirety by reference.

BACKGROUND

The embodiments herein relate generally to audio speaker systems and, in particular, systems for processing signals from an audio source and directing those processed signals to a plurality of loudspeakers to reproduce high quality stereophonic sound.

By way of background, loudspeakers include electromechanical transducers that convert electrical signals into sound. Audio sources (e.g., stereo systems) typically generate stereophonic sound in the form of separate signals reflecting a left channel (L) and a right channel (R) that are used by electrically connected loudspeakers to generate sounds associated with the left and right channels. To reproduce stereophonic sound in a pleasing manner to listeners within the ambient of the audio source and loudspeakers, a conventional stereo system is typically placed such that at least one loudspeaker reproducing left channel sound is positioned to the left of the listener, while at least one other loudspeaker reproducing right channel sound is positioned to the right of the listener. Other loudspeakers may be employed with audio sources, such a center speakers that combine left and right channel signals or have a dedicated center channel signal, additional left and right channel loudspeakers positioned as a pair in a forward and a rearward position, and a subwoofer to which low frequency signals are parsed from the audio source and reproduced by the subwoofer to present the low bass sounds for the listener.

In many environments, the proper placement of loudspeakers can be difficult to achieve because the sounds reproduced by the plurality of speakers cross paths and, indeed, often interfere with each other. For example, in a portable electronic device, the left loudspeaker and the right loudspeaker may be placed so close together that the resulting stereo separation is inadequate. In another example with separate left and right loudspeakers, space on a countertop or a desktop may be too limited for relatively good placement of the loudspeakers, and in both examples best fidelity is achieved at only one listening position, usually directly in front of and centered between the left and right loudspeakers. In addition, many people do not possess the expertise necessary to position separate loudspeakers for relatively good sound field reproduction.

Many surround-sound systems reflect expertise in loudspeaker layout to minimize interference and maximize robust quality of sound. One desirable result is the reduction in the discernable detection of the point source of sound reproduction; i.e., detection from where the sound is specifically coming. There is a desire among audiophiles to present stereophonic sound reproduced seamlessly throughout the environment, while still detecting the high, medium and low frequency qualities of the sound output.

One problem faced by system designers is providing broad and robust sound where the speakers are presented in a compact, single-body environment, such as a sound bar. The close proximity of the speakers tends to present narrower sound fields, which come across as less robust, and less distinguishable vis-à-vis the variety of frequencies in audio. In other words, less sound separation is achieved. Indeed, the inventor of the present embodiments herein described efforts at addressing this particular problem, presenting meaningful embodiments in U.S. Pat. No. 8,175,304 to North, the contents of which are incorporated herein by reference. Indeed, reference is made to FIG. 1 of this patent, which excerpts FIG. 4 from the '304 patent. Embodiments of the present invention herein also address at least some of the difficulties in satisfying the desire for broad field sound emanating from compact speaker environments.

SUMMARY

One of several possible sound system processors are provided that are configured to enhance the quality of sound produced by reducing the perception of point-source sound generation. In some embodiments of the present invention, a sound system processor is provided for use with speakers to reduce the perception of point-source sound generation, where the sound system processor comprises a first sum processor configured to process (i) one of two left signals split from the left signal from the audio source and (ii) one of two right signals split from the right signal from the audio source, where the output of the sum processor is a composite left plus right signal; a high past filter configured to process (i) the other of two left signals split from the left signal from the audio source and (ii) the other of two right signals split from the right signal from the audio source, where the output is a high pass left signal and a high pass right signal, the high pass left signal being split into a first and second high pass left signal, the high pass right signal being split into a first and second high pass right signal; a low pass filter configured to take the composite left plus right signal and generate a composite low pass filter left plus right signal, which can then be split into a first, second and third split composite low pass filter left plus right signal; a second sum processor configured to combine the first high pass left signal with the first high pass right signal so as to generate a composite high pass left plus right center signal; a difference processor configured to subtract one from the other of the second high pass left signal and the second high pass right signal so as to generate a first side signal and a second side signal; a third sum processor configured to combine the first split composite low pass filter left plus right signal with the first side signal so as to generate a composite left signal for delivery to a first speaker driver; a fourth sum processor configured to combine the second split composite low pass filter left plus right signal with the composite high pass left plus right signal so as to generate a composite left plus right center signal for delivery to a second speaker driver; and a fifth sum processor configured to combine the third split composite low pass filter left plus right signal with the second side signal so as to generate a composite right signal for delivery to a third speaker driver. Some embodiment may further comprise an adjustable delay interposed between the difference processor and the third and fifth sum processors, where in some cases, the difference processor is a variable difference processor, with variable n set between zero and one.

In other embodiments of the present invention, a method for processing left and right channel signals generated by an audio source is provided to reduce the perception of point-source sound generation, where the method comprises directing (i) one of two left signals split from the left signal from the audio source and (ii) one of two right signals split from the right signal from the audio source through a first sum processor, where the output of the sum processor is a composite left plus right signal; directing (i) the other of two left signals split from the left signal from the audio source and (ii) the other of two right signals split from the right signal from the audio source through a high past filter, where the output is a high pass left signal and a high pass right signal, and splitting the high pass left signal into a first and second high pass left signal, and splitting the high pass right signal into a first and second high pass right signal; directing the composite left plus right signal through a low pass filter to generate a composite low pass filter left plus right signal, and splitting the composite low pass filter left plus right signal into a first, second and third split composite low pass filter left plus right signal; combining the first high pass left signal and the first high pass right signal in a second sum processor so as to generate a composite high pass left plus right center signal; subtracting one from the other of the second high pass left signal and the second high pass right signal using a difference processor so as to generate a first side signal and a second side signal; combining the first split composite signal from the low pass filter with the first side signal in a third sum processor so as to generate a composite left signal for delivery to a first speaker driver; combining the second split composite signal from the low pass filter with the composite high pass left plus right signal in a fourth sum processor so as to generate a composite left plus right center signal for delivery to a second speaker driver; and combining the third split composite signal from the low pass filter with the second side signal with a fifth sum processor so as to generate a composite right signal for delivery to a third speaker driver. The method may further comprise directing the first side signal and the second side signal into an adjustable delay interposed between the difference processor and the third and fifth sum processors. In some embodiments, the difference processor is a variable difference processor, with variable n is between zero and one.

BRIEF DESCRIPTION OF THE FIGURES

The detailed description of some embodiments of the invention will be made below with reference to the accompanying figures, wherein like numerals represent corresponding parts of the figures.

FIG. 1 shows a schematic circuit diagram of one example of a prior art speaker system;

DETAILED DESCRIPTION OF CERTAIN EMBODIMENTS

Figure 2A:
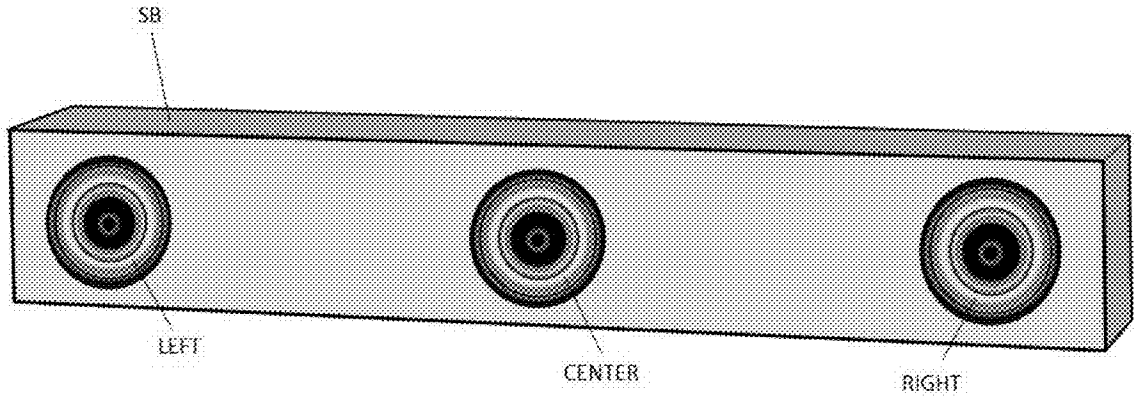
FIGS. 2A and 2B shows a schematic perspective view of one example of a compact speaker system, such as a sound bar.

By way of example, and referring to FIG. 2A, one example of a generic compact speaker system is shown for context of one application of the embodiments of the present inventive systems. In that regard, a compact speaker system SB comprises a housing for incorporating a plurality of speakers. In this one example of a compact speaker system, which may be in the configuration of a sound bar that could be used as a stand alone system or incorporated into a larger housing associated with audio systems, furniture, walls, etc., the compact speaker embodiment SB comprises a LEFT speaker, a CENTER speaker, and a RIGHT speaker, each positioned on a front-facing wall and each associated with their own respective speaker drivers. Combinations of drivers may be employed in co-axial or tri-axial speakers for use in the speaker system, if so desired. Indeed, numerous possible arrangements of speakers may be employed in a compact environment, including the incorporation of various types of speakers, such as tweeters, mid-range speakers, sub-woofers, and passive radiators. The embodiment of FIGS. 6A and 6B reflects another example of a compact speaker box SB, which comprises a LEFT speaker, a CENTER speaker, and a RIGHT speaker, each on separate LEFT, CENTER and RIGHT facing walls, respectively. In any case, use of the term speaker driver herein is not limited to a full-range speaker, but may be a tweeter speaker, a woofer speaker, or a combination speaker, for example, a tweeter-woofer speaker combination.

Figure 2B:
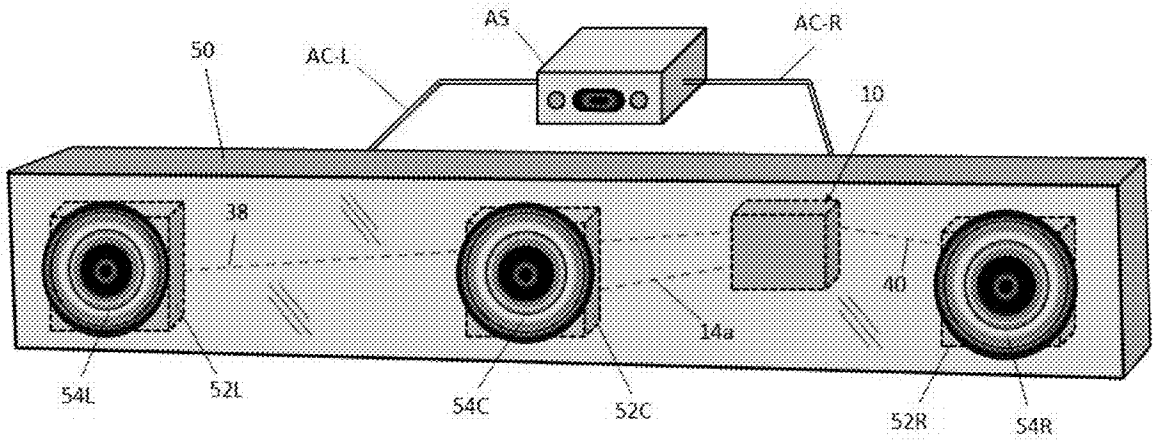

In the example shown in FIG. 2B, a specific speaker system embodiment 50 receives a left channel signal AC-L and a right channel signal AC-R from audio source AS. The audio source, of course, may be one of numerous analog and digital systems configured to generate audio signals, whether alone or in combination with video signals. It should be noted that the signals may be transmitted wired or wirelessly, as a person of ordinary skill in the art would have known from the prior art, including the art preceding the '927 Application to North incorporated herein by reference.

Within the speaker system 50, a processing system 10 may be incorporated to process the left and right channel signals from the audio source to generate pleasing robust sound from the speakers. As an example of one embodiment of a processing system 10, reference is made to FIG. 3, where a dotted line is drawn around the components of the processing system, which receives left and right channel signals AC-L and AC-R from audio source AS to generate signals sent to speaker drivers 52L, 52C and 52R. A passive radiator may be positioned on the front facing and/or rear-facing wall in place of an added rear speaker with associated rear speaker driver, and/or in addition to the front three-channel speakers and/or a rear speaker.

Figure 3:
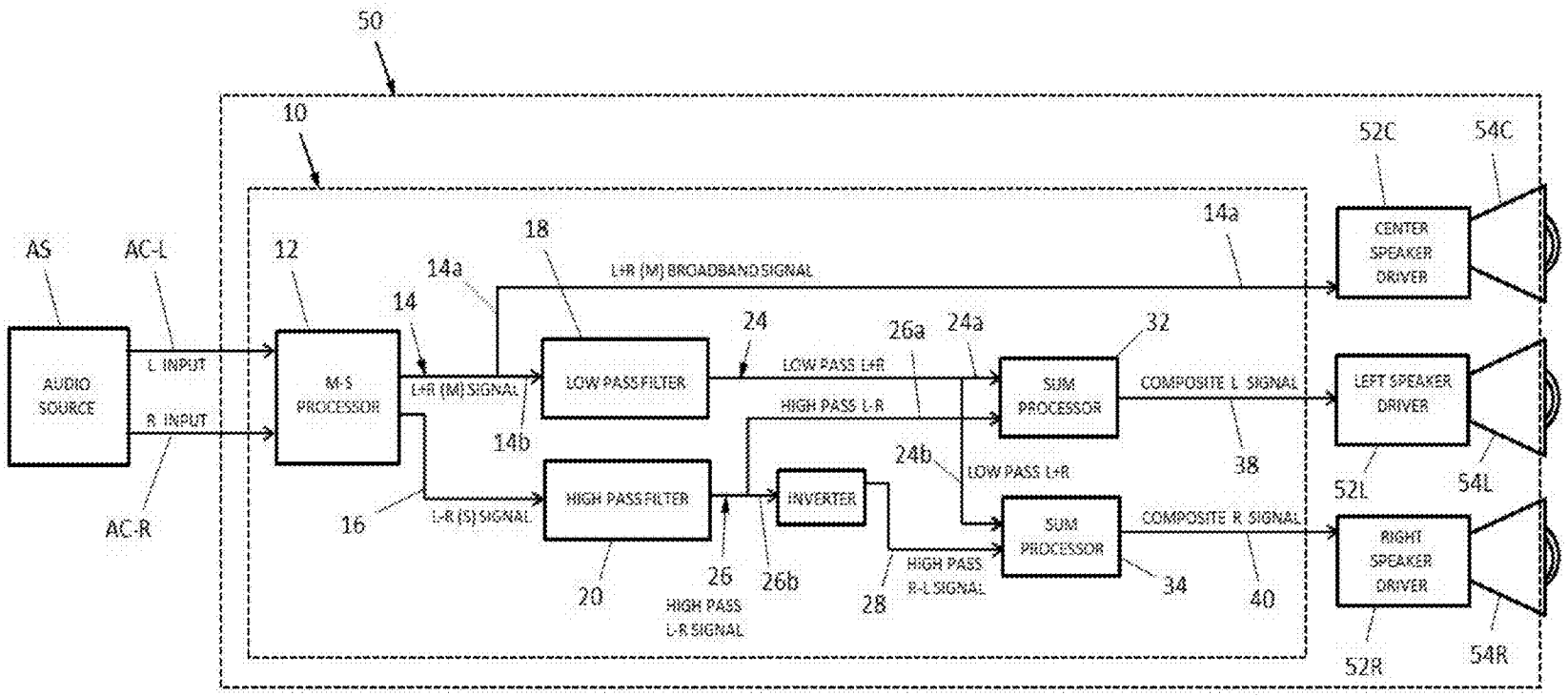
FIG. 3 shows a schematic circuit diagram of one embodiment of the present invention useful in speaker systems, including compact speaker systems.

The components illustrated in FIG. 2B correspond to components identified more specifically in association with FIG. 3. In that regard, in the embodiment of FIG. 3, by example, the processing system 10 may comprise a mid-side processor 12 configured to receive both the left and right channel input signals from the audio source AS. The output of mid-side processor 12 may comprise a mid signal 14 reflecting the sum of the left and right channel frequencies to generate an L+R signal that may itself be split into two pathways 14*a* and 14*b*. The output of mid-side processor 12 may also comprise a side signal 16 reflecting the subtraction of right signal frequencies from left signal frequencies to generate an L−R signal. By example only, one of the two pathways of L+R signal 14*a* may reflect a broadband signal sent directly to a speaker driver, preferably the center speaker driver 52C. Although schematically its position is shown at the top, the center speaker driver 52C may be associated with a speaker placed anywhere within the speaker system, although preferably in a central position vis-à-vis the left and right speakers.

The second pathway of L+R signal 14*b* is preferably directed through a low pass filter 18, such as a first-order-type filter, to eliminate signals of a certain frequency and above. In one embodiment, the low pass filter is configured to eliminate frequencies above about 100-800 Hz, and preferably above about 300 Hz, to generate a low pass L+R signal 24 that may be split into a first and second pathway 24*a*, 24*b* for additional processing. Of course, it is contemplated that the lower level frequency setting may be higher or lower than 300 Hz specifically within that range, depending upon how large the system is. In parallel, the L−R side signal 16 generated by the M-S processor 12 is preferably directed through a high pass filter 20 configured to eliminate frequencies of less than a pre-determined level. In the embodiment shown, the high pass filter 20 is configured specifically to eliminate frequencies below about 100-800 Hz, and preferably below about 300 Hz, although the pre-determined level may be different from within the range of 100-800 Hz, as explained above.

In this example embodiment, the output of high pass filter 20 may be a high pass L−R signal 26, which may be split into a first pathway 26*a* and a second pathway 26*b*. Preferably, the first pathway of high pass L−R signal 26*a* is joined by first pathway of low pass L+R signal 24*a* as dual inputs to processor 32 for conversion into a single composite signal. In some embodiments, processor 32 functions as a sum processor. In parallel, the second pathway of high pass L−R signal 26*b* is directed into an inverter to generate an inverted high pass R−L signal 28. This inverted high pass R−L signal 28 is preferably joined with the second pathway of low pass L+R signal 24*b* as dual inputs to processor 34, which is also preferably a sum processor for conversion of the dual input signals into a composite signal.

Processors 32 and 34 are configured to function as a summing circuit serving to convert two signals into one by adding the two signals together in order to generate a composite left signal 38 and a composite right signal 40. It is contemplated that the composite left signal 38 would be directed to left speaker driver 52L, while the composite right signal 40 would be directed to right speaker driver 52R. As explained above, each speaker driver may be associated with its own speaker, as for example speakers 54R, 54C and 54L associated with speaker drivers 52R, 52C and 52L, respectively, or combined together in one configuration or another. In any case, with such an arrangement as schematically reflected by example in FIG. 3, a broad sound field may be perceived by a listener even though the sound is being generated by closely-positioned speakers. Of course, a robust and broad sound field would be perceived where the speakers are positioned further apart than the compact example of FIG. 2B. It is simply noted that the arrangements and embodiments herein have particular benefit for compact speaker environments.

Figure 4:
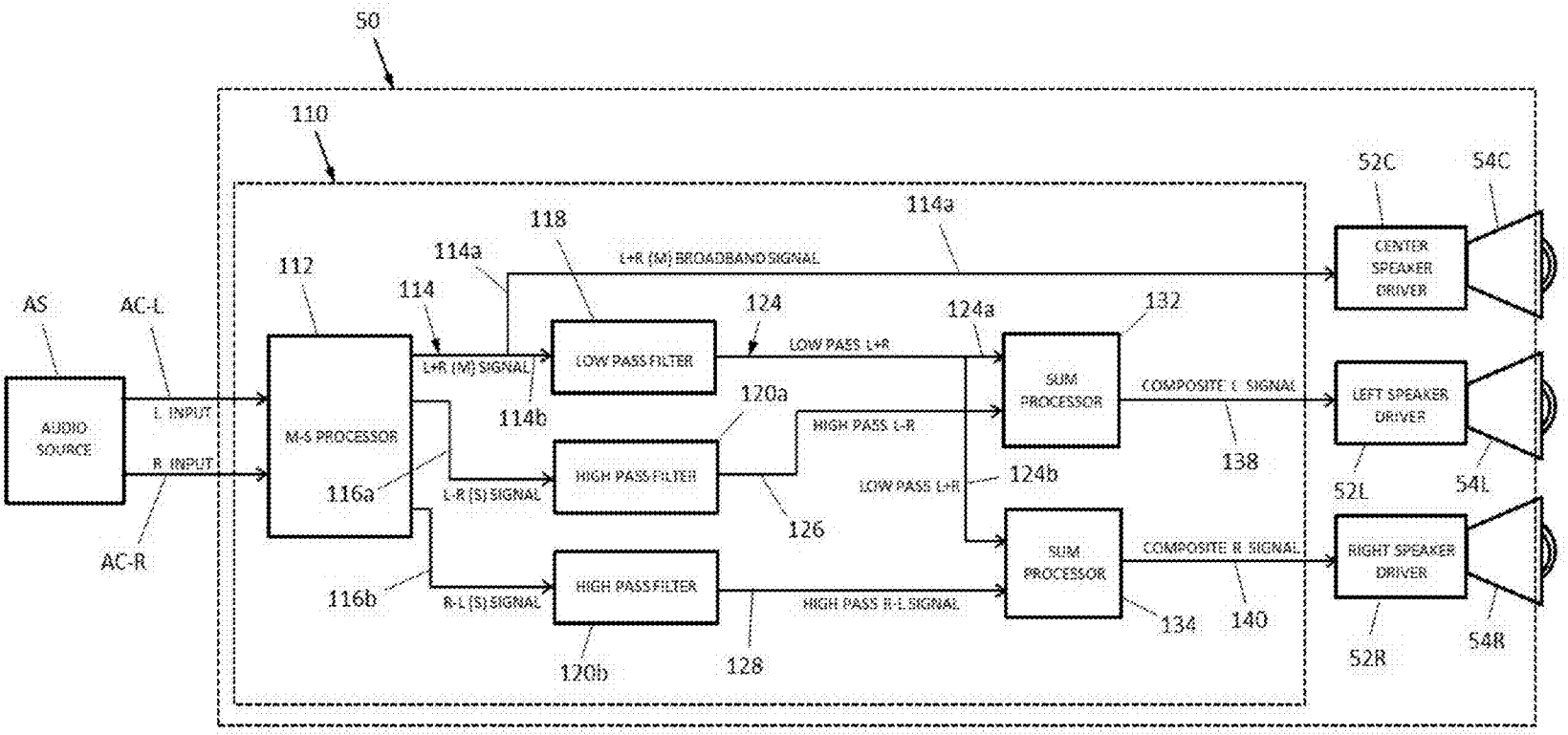
FIG. 4 shows a schematic circuit diagram of an alternative embodiment of the present invention useful in speaker systems, including compact speaker systems.

Other embodiments of left and right audio signal processors are contemplated. For example, with reference to FIG. 4, a processing system 110 may comprise a similar array of components as those reflected in FIG. 3 with some variation. In one example of a variation, a mid-side processor 112 generates three outputs rather than two, as with embodiment 10. In this embodiment, the three outputs reflect a mid L+R signal 114, split into first and second pathways 114*a* and 114*b*, as well as a side L−R signal 116*a* and a side R−L signal 116*b*. As with mid-signal 14, first and second pathways 114*a* and 114*b* are directed to a center speaker driver 52C (associated with speaker 54C) and a low pass filter 118, respectively. In this embodiment, however, the side L−R signal 116*a* and a side R−L signal 116*b* each, respectively, pass through parallel high pass filters 120*a*, 120*b*. The level of frequencies eliminated (above and below) by the low pass and high pass filters, 118, 120*a*, 120*b*, may be set of one of numerous possible levels, although in one embodiment, that level is preferably 300 Hz.

The output of low pass filter 118 is a low pass L+R signal 124 that is split into a first and second pathway 124*a*, 124*b*. The output of high pass filter 120*a* is a high pass L−R signal 126, while the output of high pass filter 120*b* is a high pass R−L signal 128. The first low pass L+R signal 124*a* is combined with the high pass L−R signal 126 as dual inputs to processor 132 for converting into a single composite signal, where the processor 132 is preferably a sum processor. Similarly, the second low pass L+R signal 124*b* is combined with the high pass R−L signal 128 as dual inputs to processor 134, which in some embodiments is a sum processor for converting two signals into a single composite signal. The filters are preferably configured as described above, but may be configured as necessary to achieve the desired functionality. Both processors 132 and 134 are configured to function as a summing circuit serving to add the two signals together in order to generate a composite left signal 138 and a composite right signal 140, directed to a left speaker driver 52L and a right speaker driver 52R, respectively. As alluded to above, in one example, each speaker driver 52L and 52R is associated with its own speaker 54L and 54R, respectively.

Figure 5:
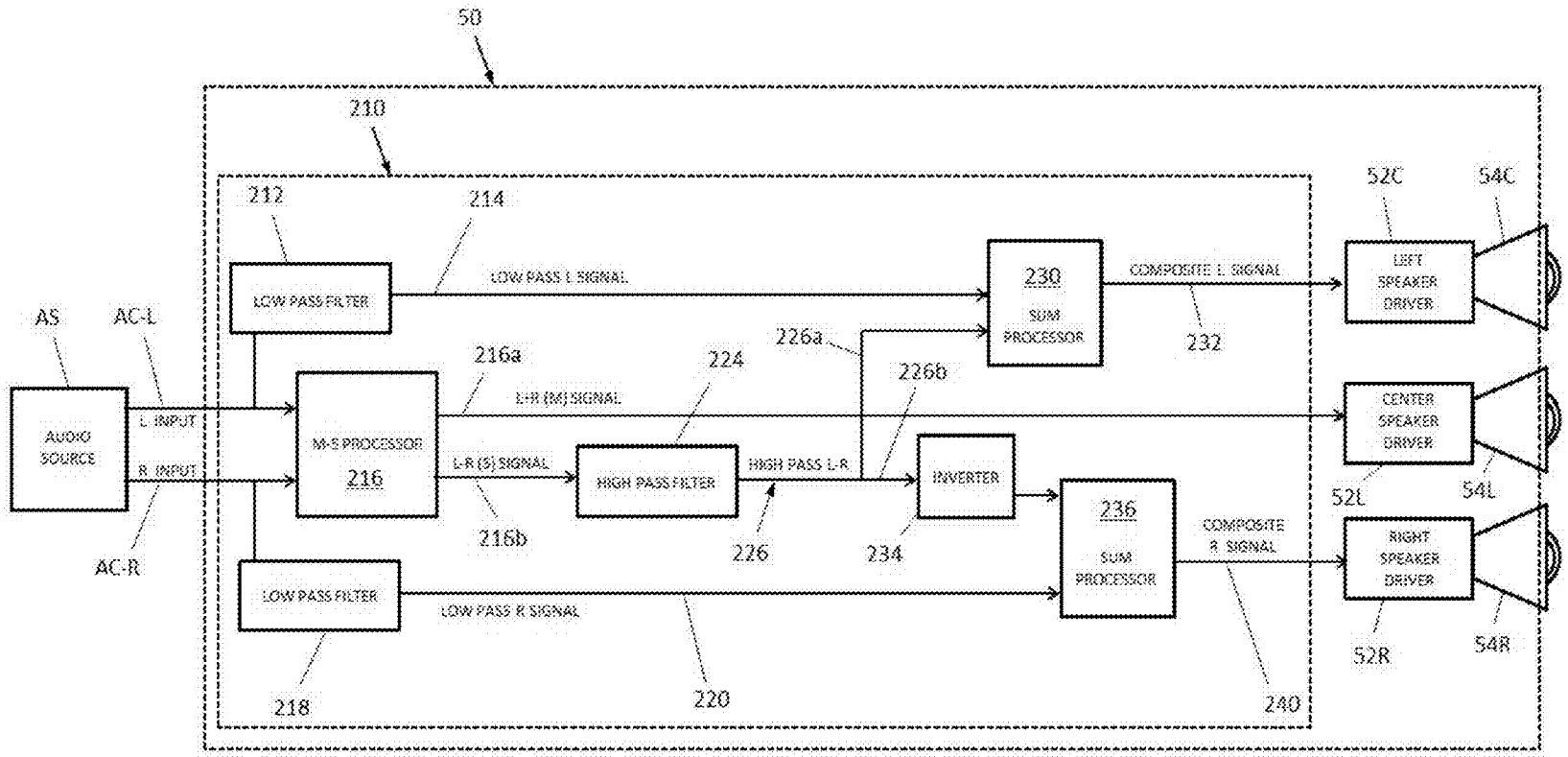
FIG. 5 shows a schematic circuit diagram of yet another embodiment of the present invention useful in speaker systems, including compact speaker systems.

In yet another embodiment of signal processor 210, shown by example in FIG. 5, the left and right channel signals are split so that each has one pathway directed into a low pass filter 212, 218, while the other pathways are joined as dual inputs to mid-side processor 216. The output of low pass filter 212 is a low pass left signal 214, while the output of low pass filter 218 is a low pass right signal 220. The output of the mid-side processor 216 is two-fold: a mid L+R signal 216*a* and a side L−R signal 216*b*. The mid L+R signal 216*a* is directed to a center speaker driver 52C, in a manner as discussed above. Meanwhile the side L−R signal passes through a high pass filter 224 of desired frequency filter, about 100-800 Hz, and preferably about 300 Hz, to generate a high pass L−R signal 226, which is split into a first and second pathway 226*a*, 226*b*. The low pass left signal 214 is joined with the first high pass L−R signal 226*a* as dual inputs to sum processor 230 to generate a composite left signal 232 directed to a left speaker driver 52L. The second high pass L−R signal 226*b* is passed through inverter 234 to generate a high pass R−L signal and joined with the low pass right signal 220 as dual inputs to sum processor 236 to generate a composite right signal 240 directed to a right speaker driver 52R.

Figure 8A:
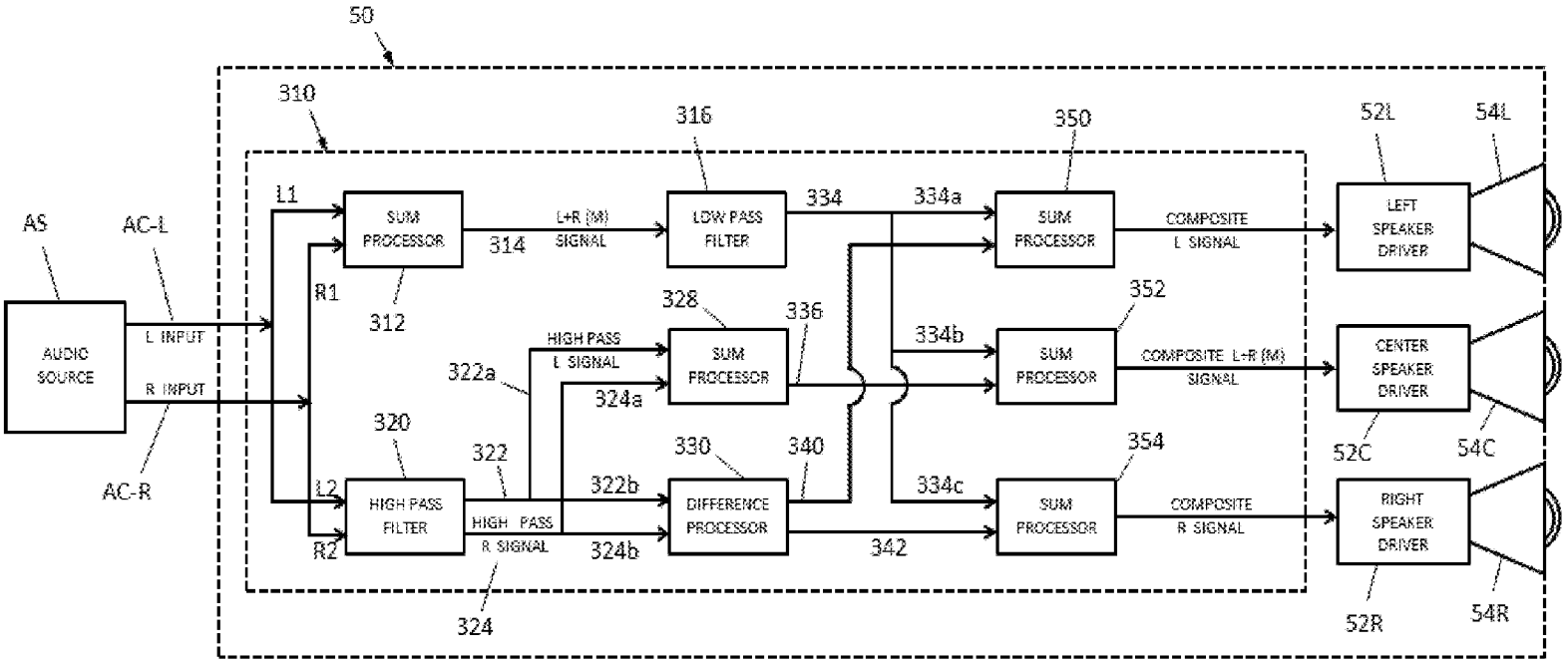
FIGS. 8A-8C show schematic circuit diagram of other embodiments of the present invention useful in speaker systems, including compact speaker systems.

In other embodiments, as reflected in FIG. 8A, the speaker system 50 comprises a signal processor 310, where a left channel signal AC-L and right channel signal AC-R are each split into separate left and right signals, L1/L2 and R1/R2, respectively. Signals L1 and R1 are directed through a sum processor 312 to generate an L+R (M) signal 314, which is then directed through a low pass filter 316. The other input split signals L2 and R2 are directed through a high pass filter 320 from which a high pass left signal 322 and a high pass right signal 324 emerge. The high pass left signal 322 is then further split, as is the high pass right signal 324. Split signals 322*a* and 324*a* are then directed through a sum processor 328, while associated split signals 322*b* and 324*b* are directed through a difference processor 330.

The output of the low pass filter 316 is signal 334, which is then split into three signals 334*a*, 334*b*, and 334*c*, each of which is directed through a sum processor 350, 352 and 354, respectively. The output of the difference processor 330 is two side signals, a first side signal (L−R) 340 and a second side signal (R−L) 342, where the first side signal (L−R) 340 joins the first split signal 334*a* into sum processor 350, and where the second side signal (R−L) 342 joins the third split signal 334*c* into sum processor 354. Meanwhile, the output 336 of sum processor 328 joins the second split signal 334*b* into sum processor 352. The output of each of the sum processors 350, 352 and 354 reflect the composite left signal, the composite left+right signal and the composite right signal, respectively, each of which is then directed to the left speaker driver, the center speaker drive and the right speaker driver, respectively.

Figure 8B:
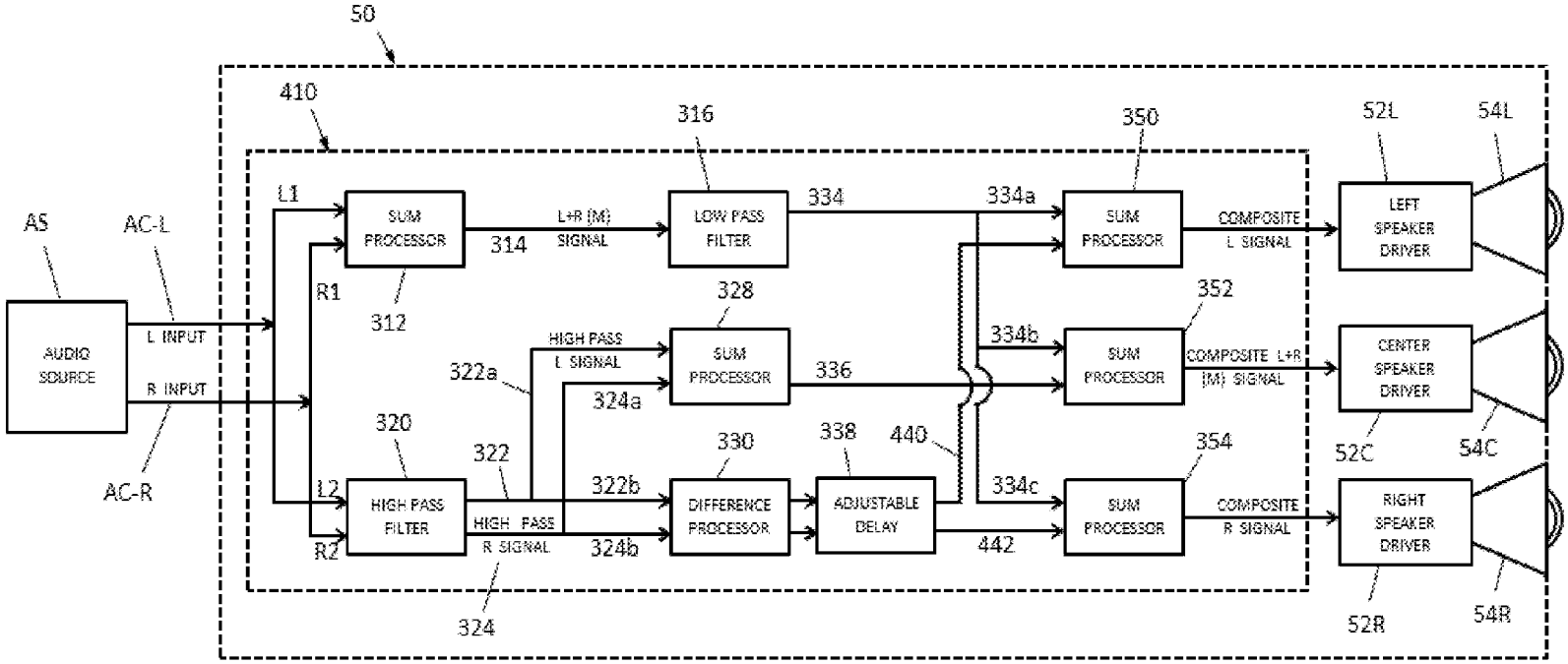

In an alternative embodiment, such as that shown in FIG. 8B, the speaker system 50 comprises a signal processor 410, where a left channel signal AC-L and right channel signal AC-R are each split into L1/L2 and R1/R2, respectively, as with the embodiments reflected by that shown in FIG. 8A. The difference here is that both of the output side signals of the difference processor 330 are directed through an adjustable delay 338 from which side signals (L−R) 440 and (R−L) 442 emerge. Those two side signals 440 and 442 are then processed the same as signals 340 and 342 in FIG. 8A.

Figure 8C:
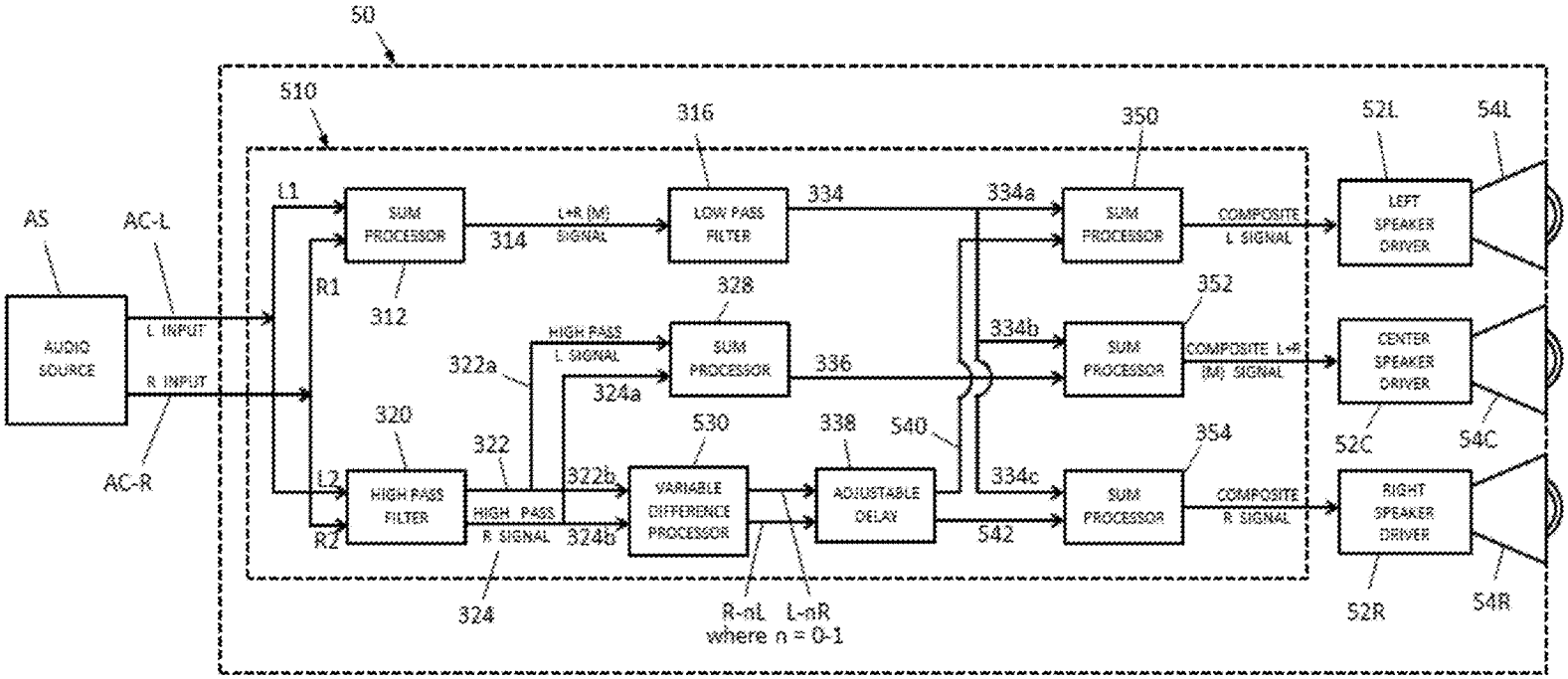

In yet another example of an alternative embodiment, as reflected by that shown in FIG. 8C, the speaker system 50 comprises a signal processor 510, where a left channel signal AC-L and right channel signal AC-R are each split into L1/L2 and R1/R2, respectively, as with the embodiments reflected by that shown in FIGS. 8A and 8B. The difference here is that split input signals 322*b* and 324*b* coming from the high pass filter 320 are then directed into a variable difference processor 530 from which emerges two variable side signals R−nL and L−nR, where n is a variable between zero and one. Those two variable signals are then directed into adjustable delay 338, and the two output side signals 540 and 542 are then processed in the same manner as 340 and 342 in FIG. 8A.

Figure 6B:
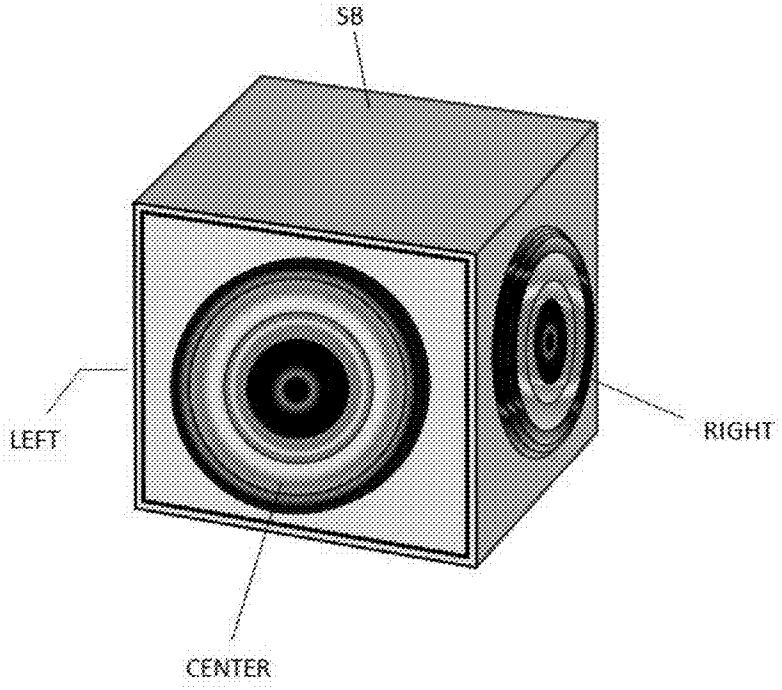
FIGS. 6A and 6B show a schematic perspective view of another example of a compact speaker system.
Figure 6A:
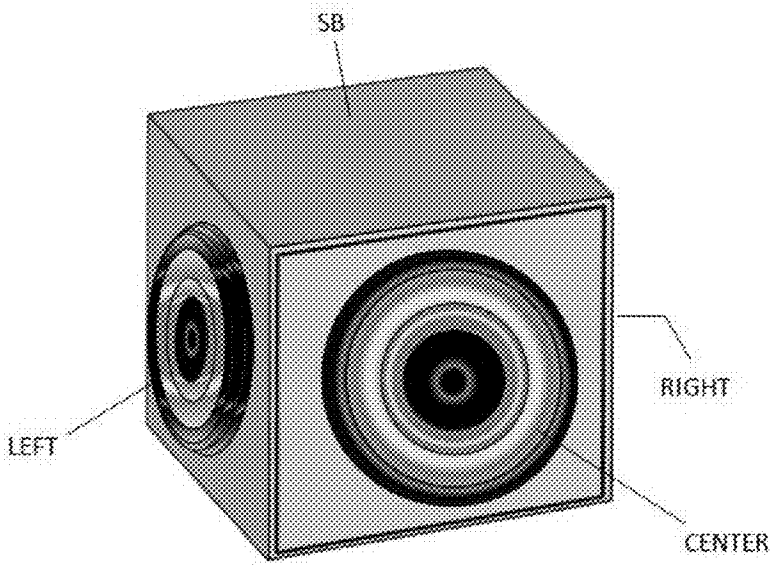

Referring to FIGS. 6A and 6B, such an arrangement of speakers is particularly useful for the examples of processor embodiments of FIGS. 3, 4 and 8A-8C. Indeed, with the examples of processor embodiments of FIGS. 3, 4 and 8A-8C, bass sound may be generated by employment of a passive radiator on the rear-facing wall, without need of a rear speaker driver. In contrast, the arrangement of front-facing speakers of FIGS. 2A and 2B is particularly useful for the example of processor embodiment of FIG. 5.

Figure 7A:
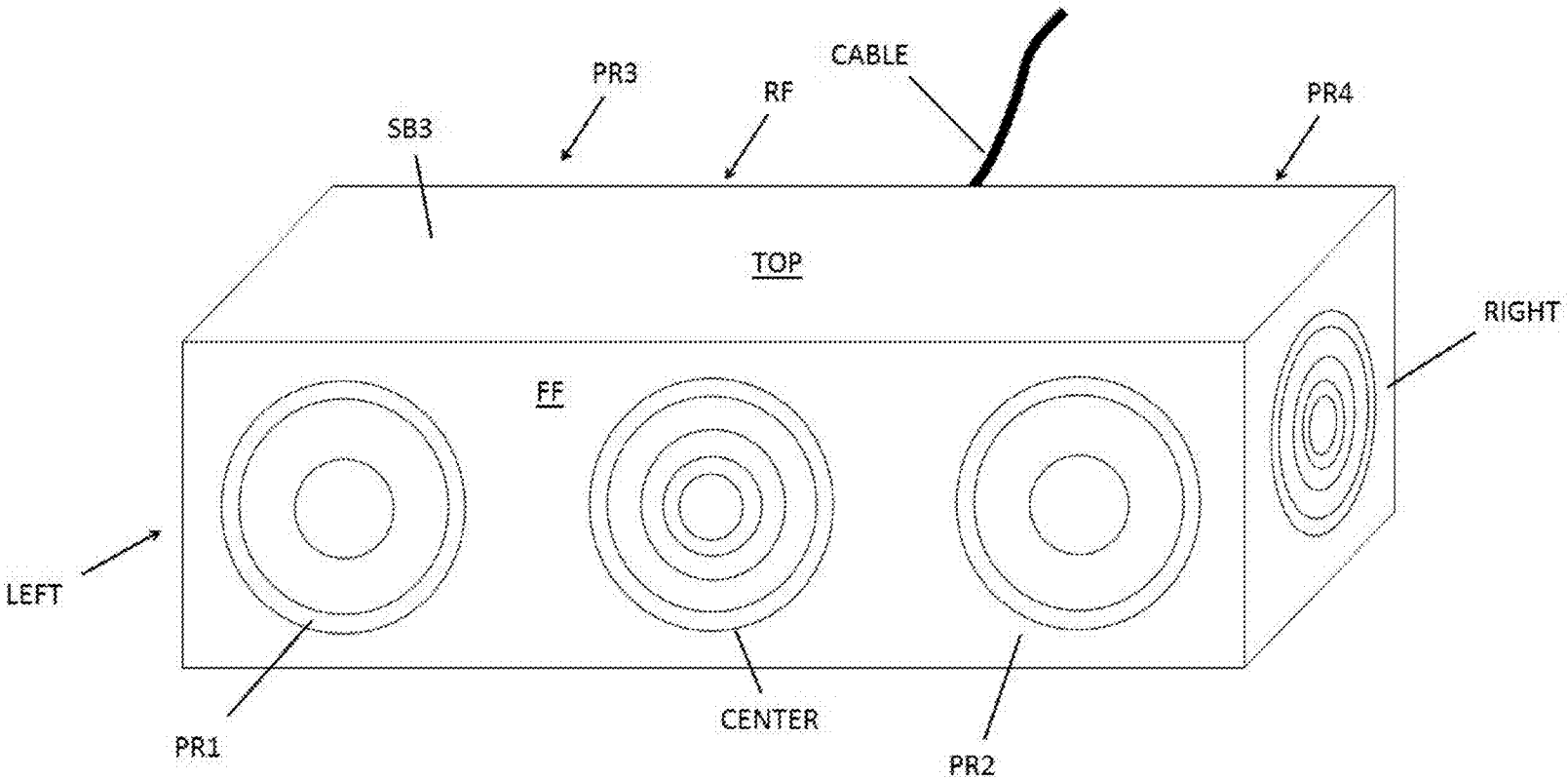
FIGS. 7A and 7B show a schematic perspective view of another example of a speaker system comprising passive radiators.
Figure 7B:
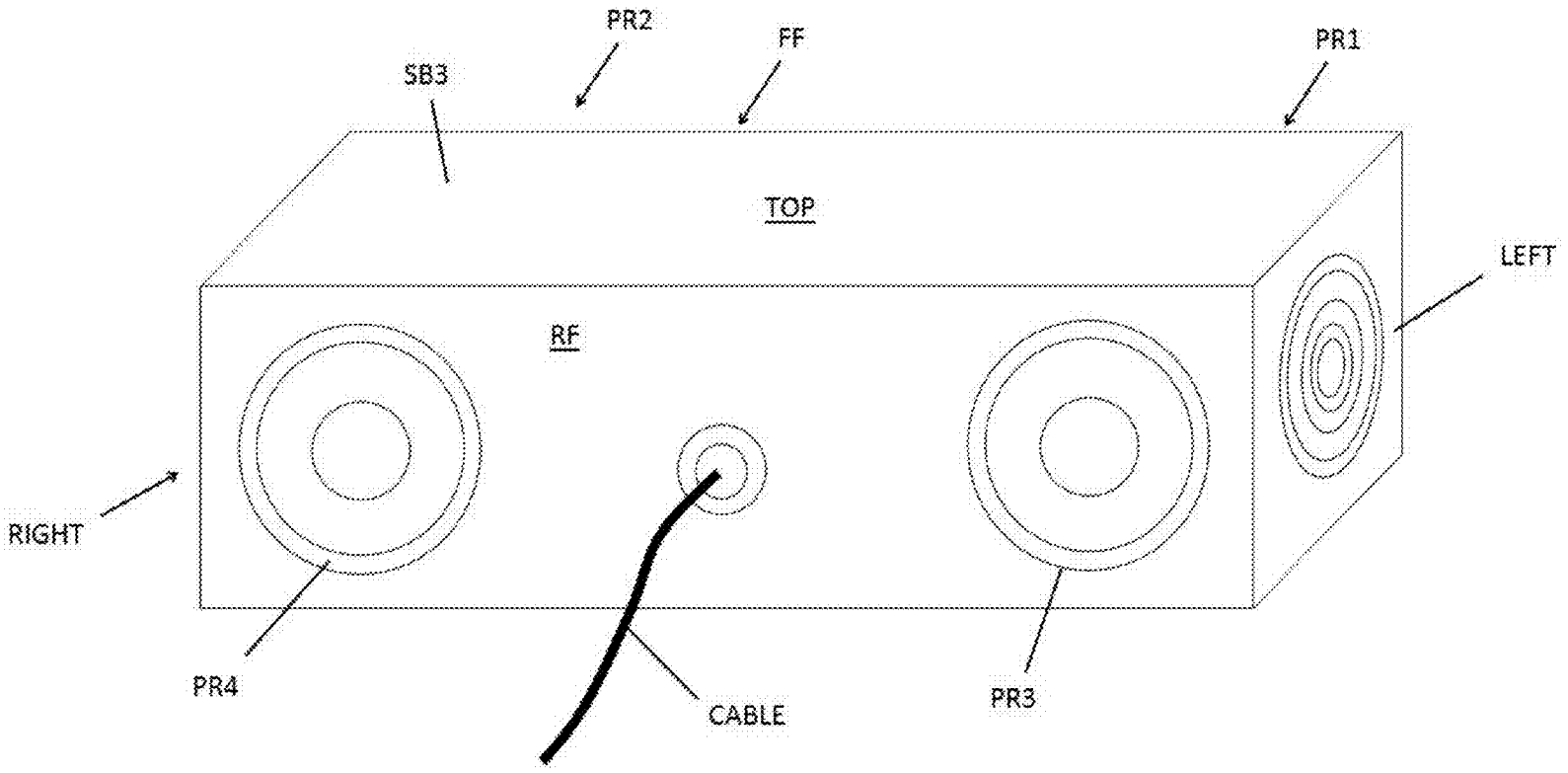

As indicated above, embodiments with passive radiators are contemplated. For example, with reference to FIGS. 7A and 7B, one embodiment that comprises a 3-way channel processor and three corresponding speakers is shown. In that regard, one embodiment comprises a sound box SB3 comprising a TOP face, a front face FF, a rear face RF and two side faces. In this example, a center-channel CENTER speaker is positioned on the front face FF, a left-channel LEFT speaker is positioned on the first side face and a right-channel RIGHT speaker is positioned on the second side face. Also positioned on the front face FF are a first and second passive radiator PR1, PR2, while on the rear face are positioned a third and fourth passive radiator PR3, PR4. Serving the sound box SB is a cable from an audio source (not shown), although it is contemplated that this speaker system, as well as others herein, may be served wirelessly from an audio source. In this embodiment, one of the three-channel processors described above may be employed. In alternative embodiments, either those that are configured the same or similar to that shown in FIGS. 7A and 7B, or those that are configured differently, a different 3-channel processor may be employed. It is contemplated that those of ordinary skill in the art will be able to vary the design weight of the passive radiators to fine tune the sound quality produced by incorporating one or more passive radiators in combination with three-channel—center, left and right—speakers.

In an alternative configuration, the speaker system of FIG. 2B may be modified to place two passive radiators on the front face as well as the three-channel speakers. In one example, a first passive radiator is positioned between the left-channel and center-channel speaker, while the second passive radiator is positioned between the center-channel speaker and the right-channel speaker.

Embodiments of the inventive system herein provide several benefits, at least one of which is to process the incoming left/right signal and produce a spacious sound field while also satisfactorily reproducing the bass frequency range without the requirement for separate woofers. In some prior art systems, including the '304 patent to North identified above, the benefit is disclosed for using smaller speakers spaced closely together to improve integration of wave fronts and produce a robust sound field. Yet, at least one drawback is the need for a separate, dedicated woofer. Embodiments of the present invention eliminate this drawback, permitting a smaller speaker housing, with the system configured to operate at least three speakers in unison to reproduce the bass frequencies while providing a spacious sound field above 300 Hz, and/or another frequency within the range of about 100-800 Hz. It reflects the science and art of balancing technical requirements (small size, strong bass, and spacious sound). It is further contemplated that embodiments of the present invention may include one or more passive radiators to enhance the sound emanating from a physically small sound field, where the passive radiators may be positioned on the front face of the speaker system, and/or the side, top and rear surfaces as well.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A sound system processor configured to enhance the quality of sound produced by reducing the perception of point-source sound generation, the sound system processor configured to process left and right signals generated by an audio source to generate output to a plurality of speakers, the sound system processor comprising:

a first sum processor configured to process (i) the left signal from the audio source and (ii) the right signal from the audio source, where the output of the sum processor is a composite left plus right signal;

a high pass filter configured to process (i) the left signal from the audio source and (ii) the right signal from the audio source, where the output is a high pass left signal and a high pass right signal;

a low pass filter configured to take the composite left plus right signal and generate a composite low pass filter left plus right signal;

a second sum processor configured to combine the high pass left signal with the high pass right signal so as to generate a composite high pass left plus right center signal;

a difference processor configured to subtract one from the other of the high pass left signal and the high pass right signal so as to generate a first side signal and a second side signal;

a third sum processor configured to combine the composite low pass filter left plus right signal with the first side signal so as to generate a composite left signal for delivery to a first speaker driver;

a fourth sum processor configured to combine the composite low pass filter left plus right signal with the composite high pass left plus right signal so as to generate a composite left plus right center signal for delivery to a second speaker driver;

and a fifth sum processor configured to combine the composite low pass filter left plus right signal with the second side signal so as to generate a composite right signal for delivery to a third speaker driver.

2. The sound system processor of claim 1, further comprising an adjustable delay interposed between the difference processor and the third and fifth sum processors.

3. The sound system processor of claim 1, wherein the difference processor is a variable difference processor, where the variable n is between a value of zero and one.

4. A surround sound speaker system comprising the sound system processor of claim 1, further comprising a plurality of speakers, a first speaker comprising the first speaker driver, a second speaker comprising the second speaker driver, and a third speaker comprising the third speaker driver.

5. The sound system processor of claim 1, wherein at least one of the drivers is a combination tweeter-woofer driver.

6. The sound system processor of claim 1, wherein at least one of the drivers is a full-range driver.

7. A method for processing signals generated by an audio source so as configured to enhance the quality of sound produced by reducing the perception of point-source sound generation, the method applicable to processing left and right channel signals generated by the audio source, the method comprising:

directing (i) the left signal from the audio source and (ii) the right signal from the audio source through a first sum processor, where the output of the sum processor is a composite left plus right signal;

directing (i) the left signal from the audio source and (ii) the right signal from the audio source through a high pass filter, where the output is a high pass left signal and a high pass right signal;

directing the composite left plus right signal through a low pass filter to generate a composite low pass filter left plus right signal;

combining the high pass left signal and the high pass right signal in a second sum processor so as to generate a composite high pass left plus right center signal;

subtracting one from the other of the high pass left signal and the high pass right signal using a difference processor so as to generate a first side signal and a second side signal;

combining the composite signal from the low pass filter with the first side signal in a third sum processor so as to generate a composite left signal for delivery to a first speaker driver;

combining the composite signal from the low pass filter with the composite high pass left plus right signal in a fourth sum processor so as to generate a composite left plus right center signal for delivery to a second speaker driver; and combining the composite signal from the low pass filter with the second side signal with a fifth sum processor so as to generate a composite right signal for delivery to a third speaker driver.

8. The method of claim 7, further comprising directing the first side signal and the second side signal into an adjustable delay interposed between the difference processor and the third and fifth sum processors.

9. The method of claim 8, wherein the difference processor is a variable difference processor, where the variable n is between a value of zero and one.

* * * * *